US010926147B2

(12) United States Patent
Greenland

(10) Patent No.: US 10,926,147 B2
(45) Date of Patent: Feb. 23, 2021

(54) GROUP SWIMMING DEVICE

(71) Applicant: Jonathan Garrett Greenland, Provo, UT (US)

(72) Inventor: Jonathan Garrett Greenland, Provo, UT (US)

( * ) Notice: Subject to any disclaimer, the term of this patent is extended or adjusted under 35 U.S.C. 154(b) by 0 days.

(21) Appl. No.: 15/464,691

(22) Filed: Mar. 21, 2017

(65) Prior Publication Data

US 2017/0296895 A1 Oct. 19, 2017

Related U.S. Application Data

(60) Provisional application No. 62/311,188, filed on Mar. 21, 2016.

(51) Int. Cl.

| | |
|---|---|
| ***A63B 69/12*** | (2006.01) |
| ***E04H 4/14*** | (2006.01) |
| ***A63B 71/00*** | (2006.01) |

(52) U.S. Cl.

CPC ..... *A63B 69/12* (2013.01); *E04H 4/14* (2013.01); *A63B 71/0054* (2013.01); *A63B 2208/03* (2013.01); *A63B 2244/20* (2013.01); *E04H 4/143* (2013.01)

(58) Field of Classification Search

CPC . A63B 69/12; A63B 2208/03; A63B 2244/20; A63B 71/0054; E04H 4/14; E04H 4/143

See application file for complete search history.

(56) References Cited

U.S. PATENT DOCUMENTS

| | | | | |
|---|---|---|---|---|
| 793,288 | A * | 6/1905 | Faber | A63B 69/18 482/69 |
| 3,445,941 | A * | 5/1969 | Burke | A63B 69/12 434/254 |
| 4,948,118 | A * | 8/1990 | Miraglia | A61H 3/008 104/62 |
| 5,192,256 | A * | 3/1993 | Ryan | A63B 69/12 482/55 |
| 9,604,088 | B2 * | 3/2017 | Djang | A63B 69/12 |
| 2006/0189453 | A1 * | 8/2006 | Leblond | A63B 69/18 482/69 |

* cited by examiner

*Primary Examiner* — Sundhara M Ganesan
(74) *Attorney, Agent, or Firm* — Strong & Hanni, PC; Joseph Shapiro

(57) ABSTRACT

An apparatus and method for swim training are disclosed herein. In one embodiment, a cable is secure to a starting block or other fixed object at or near the edge of a pool, and the cable is then extended into the pool. The cable includes, along its length, fixed securement points to which multiple swimmers may be secured, via belts worn by the swimmers, to the cable. Because the swimmers are secured to fixed positions along the cable, multiple swimmers may swim in the same lane without interfering with each other. In another embodiment, the cable may be secured at both ends of the pool.

9 Claims, 5 Drawing Sheets

GROUP SWIMMING DEVICE

BACKGROUND OF THE INVENTION

Swimming is a popular sport, both recreationally and competitively. Most swimming happens in a swimming pool, which is generally divided into lanes. A swimming lane is often delineated by a lane divider that floats on top of the water. Usually one lane divide delineates each lane edge. Lane dividers are generally secured to hardware built into the side of the swimming pool. Each lane provides space for one or more swimmers to swim laps. In an ideal scenario, a swimming pool has enough lanes for each swimmer to have his or her own lane. However, because of the scarcity of swimming pools and/or lap pools, more than one swimmer often shares a lane.

Lane sharing works best when the number of swimmers is minimized and when swimmers swim at the same speed. In one lane sharing scenario, two swimmers may share a lane by dividing the lane lengthwise (i.e., along the length of the lane) into two sub-lanes. Each swimmer may then swim laps, with minimal interference from the other swimmer, by staying on his or her side of the lane.

In another common scenario, two or more swimmers may share a lane by swimming in a loop or cycle, e.g., swimming laps by switching lane sides at every turnaround, such that a swimmer is always on his right, or always on his left, side of the lane. Although this approach may accommodate multiple swimmers, it suffers from several drawbacks: First, swimmers in a lane must frequently pass each other. Depending on the width of the lane, each such passing incident generally results in some, even minor, obstruction, to each swimmer. Second, unless all swimmers in a lane swim at the exact same speed, swimmers will frequently overtake each other because one swimmer is swimming faster than another. When a faster swimmer overtakes a slower swimmer, the faster swimmer must either slow down to the speed of the slower swimmer or attempt to pass the slower swimmer, which will frequently be virtually impossible because of other swimmers in the same lane swimming in the opposite direction and thereby occupying what could otherwise be a channel for passing. The problems resulting from swimmers swimming at different speeds are compounded as the number of swimmers in a lane increases, or the differences in swimming speeds widens, or as the constancy of the speed at which one or more swimmers swims decreases.

What is needed is a method and apparatus that alleviates and/or mitigates these problems associated with multiple swimmers in a lane.

BRIEF SUMMARY OF THE INVENTION

In one embodiment, a cable is secured to a securement support, e.g., a starting block, at or at or near the edge of a pool, and the cable is then extended into the pool. The cable includes, along its length, fixed securement points to which multiple swimmers may be secured, via belts worn by the swimmers, to the cable. Because the swimmers are secured to fixed positions along the cable, multiple swimmers may swim in the same lane without interfering with each other.

In another embodiment, the cable may be secured at both ends of the pool. If slack is left in the cable, the cable may run through the water. The cable may also be tightened so that it runs above the water. The securement points may include a segment of cable sufficient to reach the swimmer's belt in the water.

DETAILED DESCRIPTION OF THE INVENTION

This application claims priority to U.S. Provisional No. 62/311,188 (inventor: Jonathan Greenland; title: GROUP SWIMMING DEVICE) filed on Mar. 21, 2016.

A method and apparatus are disclosed to facilitate multiple swimmers swimming in one lane with obstructing each other and without, or at least with a decreased level, of the problems described above resulting from overcrowding and swimmers swimming at different speeds.

Figure 1:
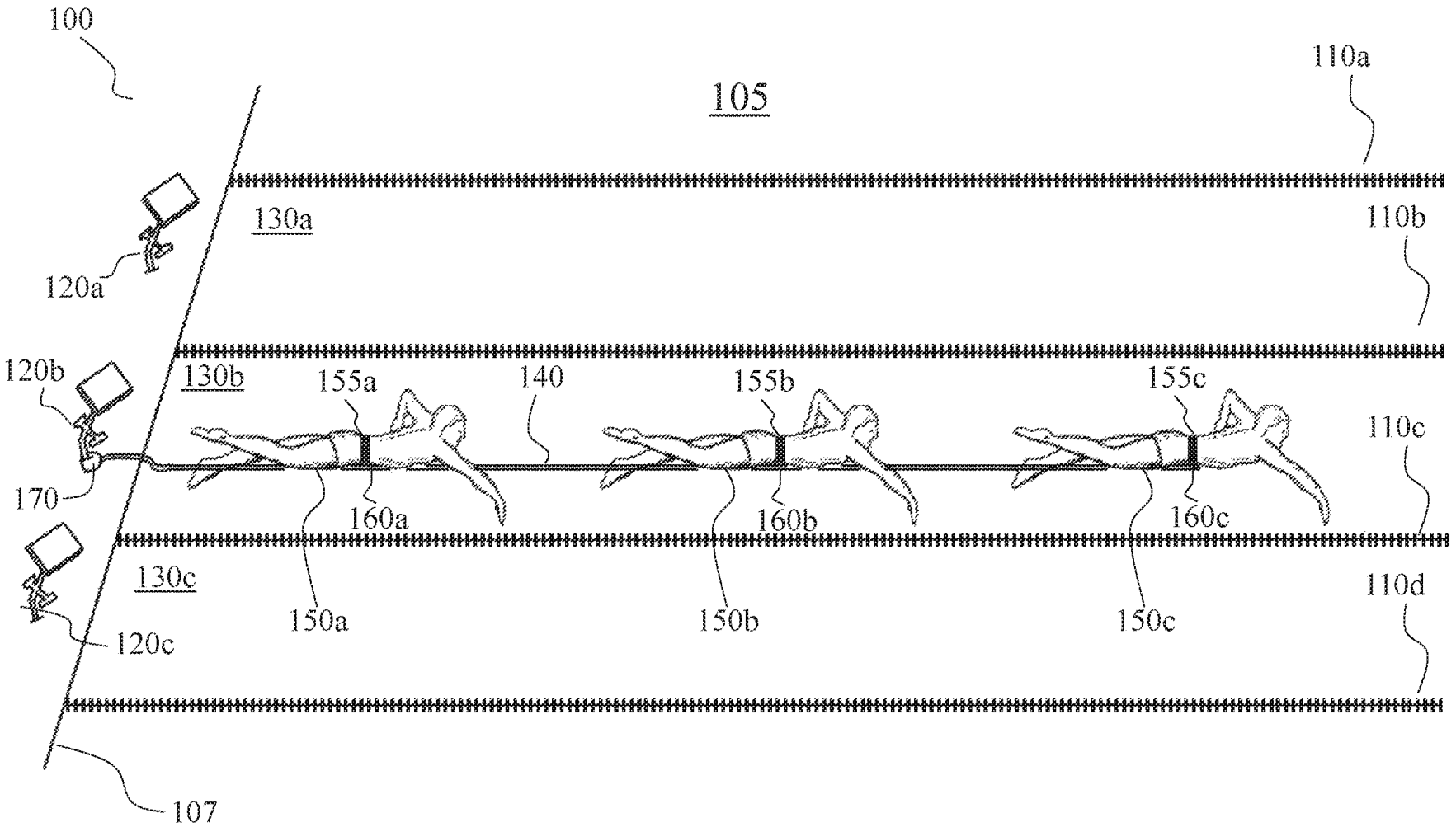
FIG. 1 illustrates an embodiment wherein one end of a cable is attached to a securement point on or outside of the edge of a swimming pool.

In a first embodiment, shown in FIG. 1, one end of a cable 140 is secured such that cable 140 extends into a swimming pool 105. Cable 140 may be secured to inner wall 107 of swimming pool 105, or to a starting block post 120*b* or apparatus, or to a wall outside the edge of swimming pool 105, or to a post or hardware apparatus beyond the edge of the pool, or to any other fixed object that is sufficiently fixed to hold in place cable 140 with swimmers 150*a*, 150*b*, 150*c* pulling on it. The thing to which cable 140 is secured may hereinafter be referred to as a securement support, which includes, but is not limited to, the swimming pool wall or edge, another wall, a post, anchored hardware or apparatus, a swimming starting block, or any other fixed object or installation to which a cable may be secured.

Cable 140 may be secured to securement support 120*b* by looping cable 140 around securement support 120*b* and securing cable 140 to itself, e.g., using a hook and clip system. Many clips are known in the art, including but not limited to a carabiner, quick link, spring link, s-hook, eye bolt, and j-bolt. In one embodiment, cable 140 may terminate with a loop that could be secured to a clip or hook affixed to or part of securement support 120*b*.

Figure 5:
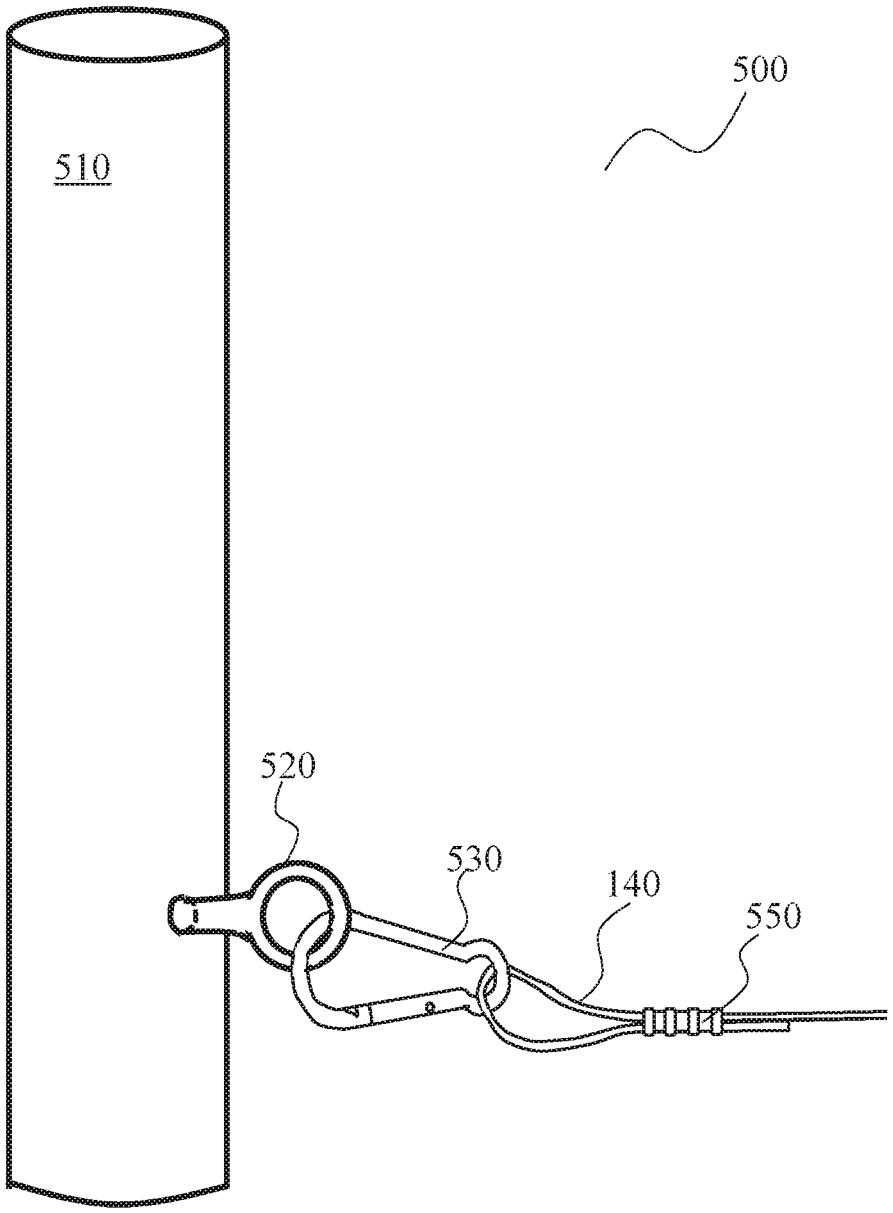
FIG. 5 illustrates an exemplary embodiment for securing a cable to a securement support such as a post.

FIG. 5 depicts an exemplary embodiment in which cable 140 is terminated in a loop using a steel cable connector 550. Many varieties of steel cable connectors, and connectors for other types of cable or rope, are well known in the art. Securement support 510 may be the post of a starting block or any other post that may be anchored or otherwise secured outside the edge swimming pool 105. Eyelet bolt 520 may be secured to post 510 through a hole in post 510 and using a lock nut and possibly a washer on the opposite side of post 510. Carabiner 530 may be used to secure cable 140 to eyelet bolt 520. As described herein elsewhere, the particular hardware described here is exemplary. Many other clips and hardware solutions are well known to a person of ordinary skill in the art.

Cable 140 may be made of many materials, including but not limited to metal cable (steel cable, stainless steel cable, or any other metal cable known in the art), rope (nylon, poly-manila, or any other rope known in the art), chain (steel, other metals, plastic, or any other sufficiently strong chain known in the art), or any other material that may extent into and/or across (partially or completely) pool 105. Cable 140 may also be a combination of one or more of these materials.

Although it may be possible to implement the invention disclosed herein with a rigid cable, in a preferred embodiment cable 140 is not rigid. Further, although it may be possible to implement the invention disclosed herein with cable that is elastic, or partially elastic, in a preferred embodiment the cable is substantially non-elastic.

Cable 140 may be of any length, depending on the length of pool 105 and/or the number of swimmers 155 that will be secured to cable 140. Cable 140 may also be extendable, e.g., by adding one or more additional segments of cable. The extensions may be added or secured to cable 140 by a loop and clip (loop on one cable and clip on the complimentary cable end), or in any other manner known in the art for connecting and/or securing cable segments.

In a preferred embodiment, the diameter or thickness of cable 140 is as small as possible such that cable 140 is still sufficiently strong for the strain of securement to swimmers 155 and securement to one or more securement supports 120. In one embodiment, cable 140 may be ¼" diameter steel cable.

For example, if pool 105 is 50 meters long, cable 140 may be of sufficient length to extend the entire length of pool 105, or almost the entire length of pool 105 after being secured to securement support 120*b* on one end of pool 105.

To employ cable 140 for swimming, one or more swimmers 150 (105*a-b*) is secured to cable 140 along the length of cable 140. In a preferred embodiment, swimmers 150 secured to cable 140 are separated at a distance at least great enough such that swimmers 150 do not touch or obstruct adjacent swimmers along cable 140 at any point during swim stroking. For example, assuming that no swimmer is taller than 6'6", and that a swimmer's arm stroking motion will never result in the tip of either of the swimmer's hands extending more than one and a half feet beyond the swimmer's head, swimmers may be secured to the cable such that each swimmer is allowed a length of at least 8 ft. in the pool. In this exemplary embodiment, in a 50-meter pool (164 ft.), 20 swimmers may fit along the length of a cable extending across the length of the pool.

Swimmers 150 are secured along the length of cable 140, and cable 140 is secured to securement support 120*b*, such that, when swimmers 150 engage in swim stroking, cable 140 holds each swimmer 150 in place. In this manner, the number of swimmers 150 that can simultaneously swim along any virtual line extending into or across the pool, e.g., along a cable 140 secured to a securement support 120*b*, is increased and likely maximized.

In one embodiment, cable 140 is secured to securement support 120*b* and runs into and through pool 105, below swimmers 150, and is secured to each swimmer 150 at securement points 160 (160*a-c*). Depending on particular strokes or swimming exercises, cable 140 may in some embodiments run above one or more swimmers 150.

Cable 140 may be secured to a swimmer 150*a* via a belt 155*a* on swimmer 150*a*. As will be appreciated by a person of ordinary skill in the art, many styles of belts may be feasible for this application. In one embodiment, belt 155*a* may wrap around a swimmer's 150*a* waist and may be clasped via buckle, clip (e.g., side release clip), or other securement mechanism for belts, many of which are known in the art. Belt 160*a* may be made from fabric, nylon webbing, padded material, or any other belt material known in the art. In general, the belt will be more durable if made from a waterproof or water-resistant material. As used herein, "belt" includes any type of belt or harness that may be used for securing an item, e.g., a cable, to a swimmer.

Belt 155*a* and cable 140 may include an apparatus for securing belt 155*a* to cable 140. In one embodiment, belt 155*a* may have one or more integrated loops or holes through which a clip (e.g., carabiner) may by placed to secure the belt to the cable. To facilitate flexibility for different swimming strokes and/or exercises (e.g., freestyle, backstroke, sidestroke, breaststroke, butterfly, etc.), a belt may have multiple securement locations and/or may be rotatable so that securement locations are changed to be at a different point or points around a swimmer's waist.

Cable 140 may have integrated loops or holes for the same purpose. For example, if cable 140 is made of stainless steel, cable 140 may be looped with a piece of hardware to hold the loop in place, or may have a piece of hardware including a loop or hole that is be secured to the cable. Examples of such hardware include ferrules, cable ferrules, quick links, spring links, and o-rings. Similar approaches may be employed for cables of materials other than stainless steel. Many pieces of hardware are well known in the art for securing a loop or hole to cable 140 at a fixed location on cable 140.

Figure 4:
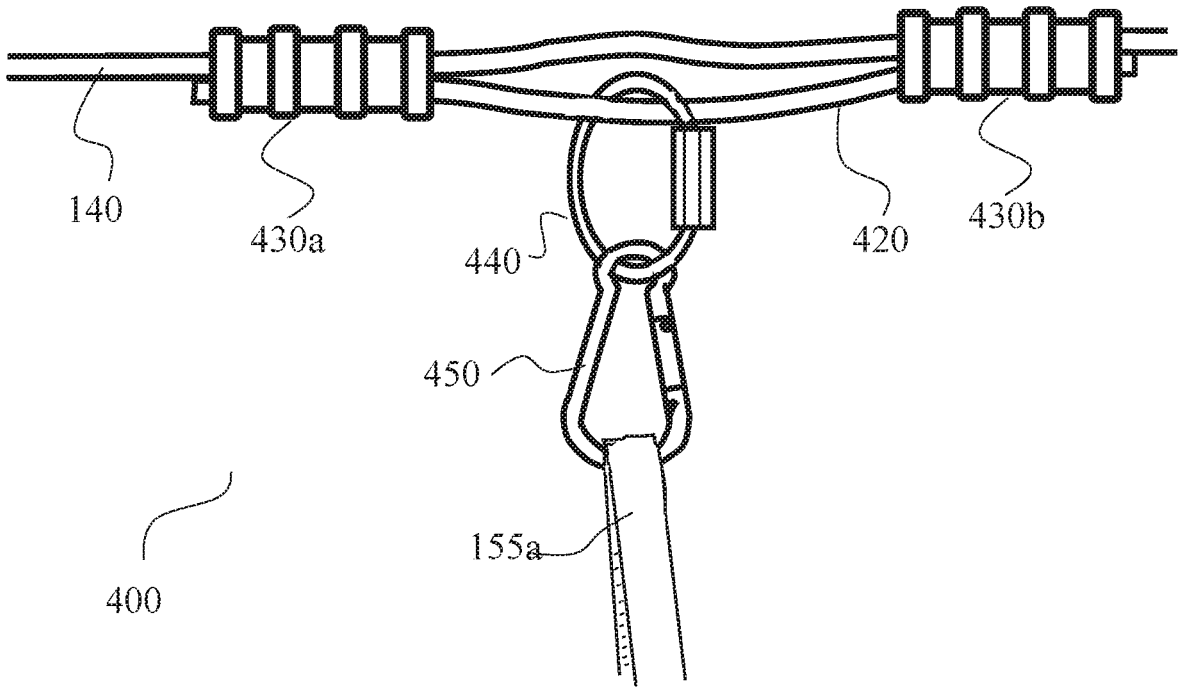
FIG. 4 illustrates an exemplary embodiment for securing a belt to a securement point on a cable.

FIG. 4 shows an exemplary embodiment for securing belt 155*a* to cable 140. A securement point on cable 140 may be made by using connectors 430*a* and 430*b* to connect a short segment of supplementary cable 420 to cable 140. A clip, e.g., quick link 440, may be secured to the loop formed by cable segment 420, cable 140, and connectors 430*a* and 430*b*, and may be secured to belt 155*a* using carabiner 450. A person of ordinary skill in the art will appreciate and recognize that many hardware solutions may be applied to secure belt 155*a* to cable 140.

The apparatus for securing belt 155*a* to cable 140 must result in belt 155*a* being secured to a fixed location on cable 140. Otherwise swimmer 150*a* would be able to move along cable 140, thereby defeating the objective of fixing the location of the swimmer in pool 105.

Using this disclosed method and apparatus, multiple swimmers may swim in the same lane, or along the same virtual line in a pool, each secured to a fixed spot along a cable that is secured to a securement support and runs into and at least partially through the pool.

Figure 2:
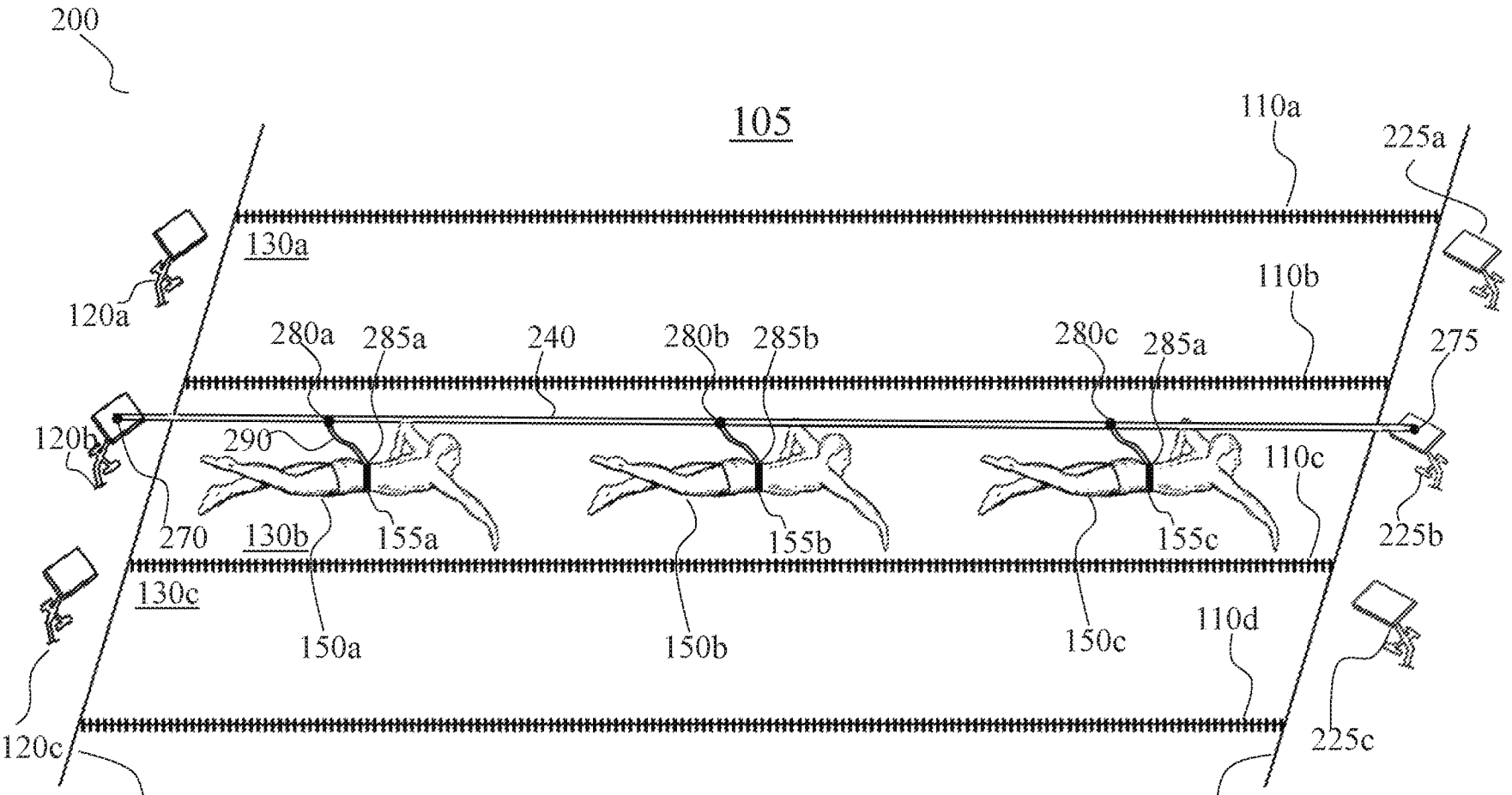
FIG. 2 illustrates an embodiment wherein both ends of the cable are secured to securement points, at opposing ends of a pool.

In an alternate embodiment, as shown in FIG. 2, a cable 240 may be secured on both ends to securement supports 120*b*, 225*b* on opposite sides 107, 108 of swimming pool 105. In this embodiment, depending on the slack in cable 240 and the height of securement supports 120*b*, 225*b*, cable 240 may run through the water, along the surface of the water, or above the surface of the water. As shown in FIG. 2, cable 240 runs above the water.

Figure 3:
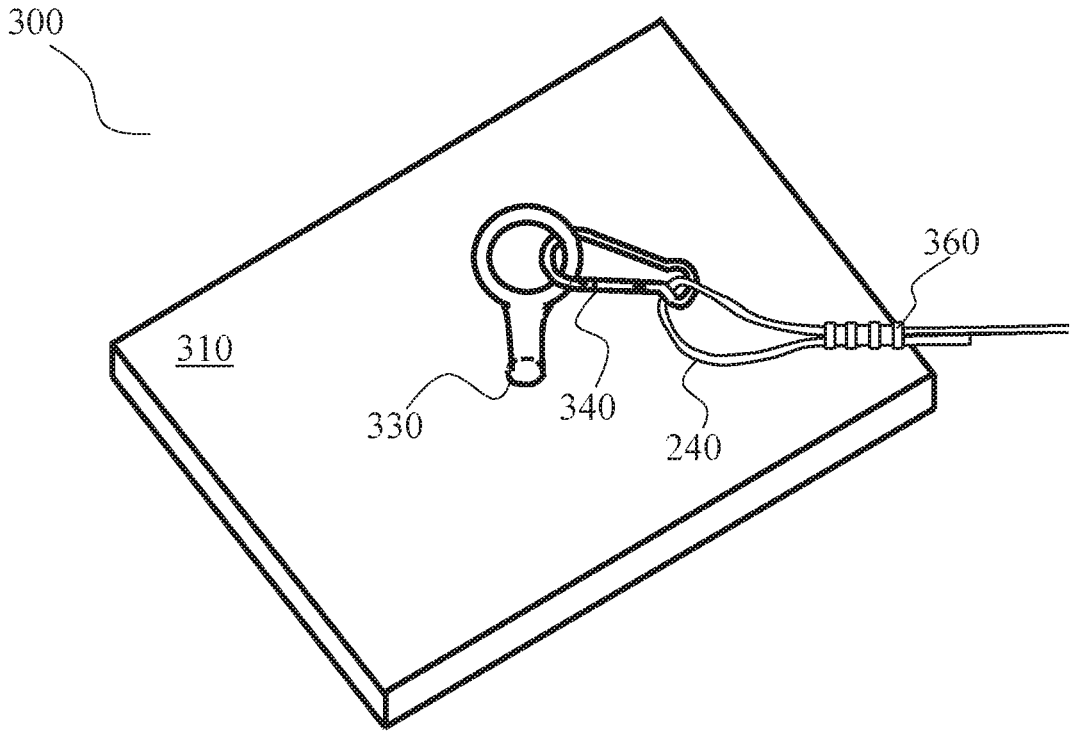
FIG. 3 illustrates an exemplary embodiment for securing a cable to a starting block platform.

FIG. 3 depicts an exemplary embodiment of securement point 270 or 275. In the depicted embodiment, an eyelet bolt 330 may be secured to a starting block platform 310 such that eyelet bolt 330 protrudes from platform surface 310. Cable 240 may terminate in a loop using connector 360. Connecting hardware, e.g., carabiner 340, may be used to secure cable 240 to eyelet bold 330. A person of ordinary skill will recognize and appreciate that many different hardware solutions may be employed to secure cable 240 to starting block platform 310, or to any other post, anchor, or securement support on the sides of the pool.

To adjust the slack/tension on cable 240, cable 240 and/or one or both of securement supports 120*b*, 225*b* may include an apparatus or mechanism for tightening or loosening cable 240, i.e., increasing or decreasing the length of cable 240 between securement points 270 and 275 on two securement supports 120*b*, 225*b*. Examples of such an apparatus of mechanism include but are not limited to a turnbuckle, a ratcheting tie-down, a ratchet wheel, a winch, and a come-along. For example, a ratcheting tie-down may be inserted in cable 240 using hooks, loops, eyelet bolts, clips, and other hardware solutions as known in the art.

In this embodiment, i.e., where cable 240 is secured to securement supports 120*b*, 225*b* at both ends, the hardware or apparatus for securing a swimmer's 150*a* belt 155*a* to cable 240 may include a segment of cable to account for the distance from cable 240 as it runs above the water to belt 155*a* on swimmer's 150*a* body, the securement point of which is near to the surface of the water. In general, although this segment of cable may be extendable, the length of this segment will function properly as long as it is not too short, because extra cable length will result in a slightly offset position of the swimmer in the water, but the swimmer will still be secured to a fixed point on cable 240, and will thereby be limited to a fixed point in the water.

Figure 6:
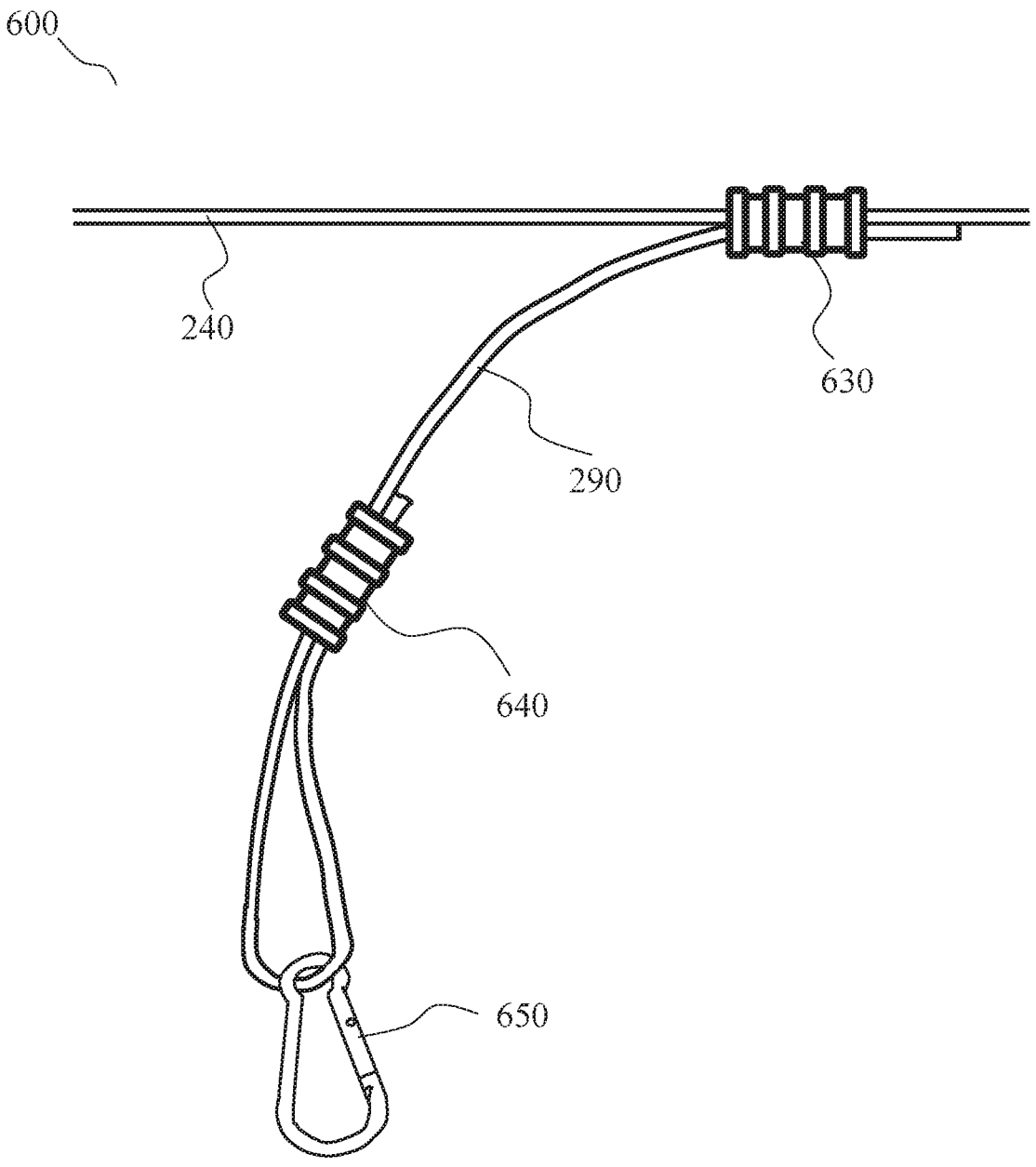
FIG. 6 illustrates an exemplary embodiment for using an extension segment to secure a belt to a cable.

FIG. 6 shows an exemplary point at which a segment of cable 290 is secured to cable 240 for the purpose of providing a securement point 285*a* for belt 155*a* on swimmer 150*a*. As shown in FIG. 6, cable segment 290 may be secured to cable 240 using connector 630. A loop termination to cable segment 290 may be formed using connector 640. Carabiner 650 may provide a securement point for securing to belt 155*a* as described herein.

The disclosure herein relating to swimmers and associated belts, and securements points, should not be construed to limit the number of swimmers or configuration of swimmers, but should instead be construed as showing that any number of swimmers may be accommodated according to the invention described depending on the size of the pool and how closely swimmers are placed or configured.

Although lane markers 110*a-d* are shows as dividing pool 105 into lanes, the invention disclosed herein does not require lane markers, or lane delineations or divisions.

According to the systems, methods, and apparatuses described herein, lane delineators/markers, as are traditionally used to mark swim lanes, may not be necessary because swimmers will be unable to deviate, or may find it much more difficult to deviate, from a virtual line in the pool that tracks the cable described herein.

In another embodiment, lane markers may remain and multiple, e.g., two, cables may be located in a lane to further increase the number of swimmers that can simultaneously swim in one lane. In this embodiment, the swimmers on the different cables may be swimming in the same direction or opposite directions.

In another embodiment, one or more securement points may be integrated into the pool floor, and a cable may be secured to a securement point in the pool floor on one end and a swimmer's belt on the other end, thereby fixing the swimmer's position in the pool.

What is claimed is:

1. A method for swimming, comprising:

securing a first end of a principal cable to a securement point of a first securement support on a first side of a body of water; and securing a second end of the principal cable to a securement point of a second securement support on a second side of the body of water;

wherein:

at least one of the securement point of the first securement support and the securement point of the second securement support is higher than the surface of the body of water; and at least one connector cable is secured at a first point of the connector cable to the principal cable and secured at a second point of the connector cable to a belt worn by a swimmer.

2. The method of claim 1, wherein the at least one connector cable is at least six inches long.

3. The method of claim 1, wherein the at least one connector cable is at least twelve inches long.

4. The method of claim 1, wherein the length of the at least one connector cable is adjustable.

5. The method of claim 1, wherein the cable comprises a second connector cable secured to at a first point of the second connector cable to the principal cable and secured at a second point of the second connector cable to a belt worn by a second swimmer.

6. The method of claim 1, wherein the principal cable is substantially parallel to the surface of the body of water.

7. The method of claim 1, wherein at least one point of the principal cable is at least ten inches above the surface of the body of water.

8. The method of claim 1, wherein the principal cable is substantially parallel to the surface of the body of water; and the principal cable is at least ten inches above the surface of the body of water.

9. The method of claim 1, wherein the principal cable comprises a tension adjustment apparatus.

* * * * *